US008761621B2

(12) United States Patent
Sakai

(10) Patent No.: US 8,761,621 B2
(45) Date of Patent: Jun. 24, 2014

(54) FIXATION DEVICE AND IMAGE FORMATION APPARATUS

(71) Applicant: Oki Data Corporation, Tokyo (JP)

(72) Inventor: Masato Sakai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 56 days.

(21) Appl. No.: 13/629,709

(22) Filed: Sep. 28, 2012

(65) Prior Publication Data

US 2013/0084088 A1 Apr. 4, 2013

(30) Foreign Application Priority Data

Sep. 29, 2011 (JP) ..... 2011-214423

(51) Int. Cl.
*G03G 15/20* (2006.01)
*G03G 15/00* (2006.01)

(52) U.S. Cl.
CPC ..... *G03G 15/5029* (2013.01); *G03G 15/2078* (2013.01); *G03G 15/2067* (2013.01)
USPC ..... 399/45; 399/67; 399/332

(58) Field of Classification Search
CPC ..... G03G 15/5029; G03G 15/2078; G03G 15/2064; G03G 15/2067
USPC ..... 399/45, 67, 69, 328, 332
See application file for complete search history.

(56) References Cited

U.S. PATENT DOCUMENTS 8,559,838 B2 * 10/2013 Ogawahara ..... 399/69

FOREIGN PATENT DOCUMENTS

JP 2011-118440 A 6/2011
JP 2012-068285 A 4/2012

* cited by examiner

*Primary Examiner* — Hoang Ngo
(74) *Attorney, Agent, or Firm* — Marvin A. Motsenbocker; Mots Law, PLLC

(57) ABSTRACT

A fixation device includes a first roller, a second roller facing the first roller, a stretch member configured to travel to pass between the first roller and the second roller, a press member configured to press the stretch member against the first roller, a heater member configured to heat the stretch member, a movement mechanism configured to move at least one of the first roller and the second roller in such directions that the first roller and the second roller come close to each other and are spaced away from each other, and a controller configured, depending on a type of a medium, to change a contact state between the first roller and the second roller by driving the movement mechanism.

20 Claims, 16 Drawing Sheets

FIXATION DEVICE AND IMAGE FORMATION APPARATUS

CROSS REFERENCE TO RELATED APPLICATIONS

This application claims priority based on 35 USC 119 from prior Japanese Patent Application No. 2011-214423 filed on Sep. 29, 2011, entitled "FIXATION DEVICE AND IMAGE FORMATION APPARATUS", the entire contents of which are incorporated herein by reference.

BACKGROUND OF THE INVENTION

Field of the Invention

This disclosure relates to a fixation device configured to fix a developer image to a medium, and relates to an image formation apparatus including the fixation device.

Conventionally, there have been image formation apparatuses such as a printer, a copier and a facsimile which each include a fixation device configured to fix an image (developer image) to a medium by using a belt (for example, Patent Document 1: Japanese Patent Application Publication No. 2011-118440 (see FIG. 2)).

SUMMARY OF THE INVENTION

However, when fixing an image to a medium, conventional fixation devices cause wrinkles (wrinkles in fixing) of the medium in some cases.

An embodiment of the invention has been made to solve the above problem, and an object thereof is to suppress the occurrence of wrinkles of a medium in a fixation process.

An aspect of the invention is a fixation device including a first roller, a second roller facing the first roller, a stretch member configured to travel between the first roller and the second roller, a press member configured to press the stretch member against the first roller, a heater member configured to heat the stretch member, a movement mechanism configured to move at least one of the first roller and the second roller in such directions that the first roller and the second roller come close to each other and are spaced away from each other, and a controller configured, based on a type of a medium, to change a contact state between the first roller and the second roller by driving the movement mechanism.

According to the aspect, it is possible to suppress the occurrence of wrinkles of a medium in a fixation process.

BRIEF DESCRIPTION OF THE DRAWINGS

FIG. 1A shows a configuration of a fixation device. FIG. 1B shows a configuration of a nip portion of the fixation device.

FIG. 13A shows a sectional structure of a fixation roller, and FIG. 13B shows a sectional structure of a pressure roller.

DETAILED DESCRIPTION OF EMBODIMENTS

Figure 1A:
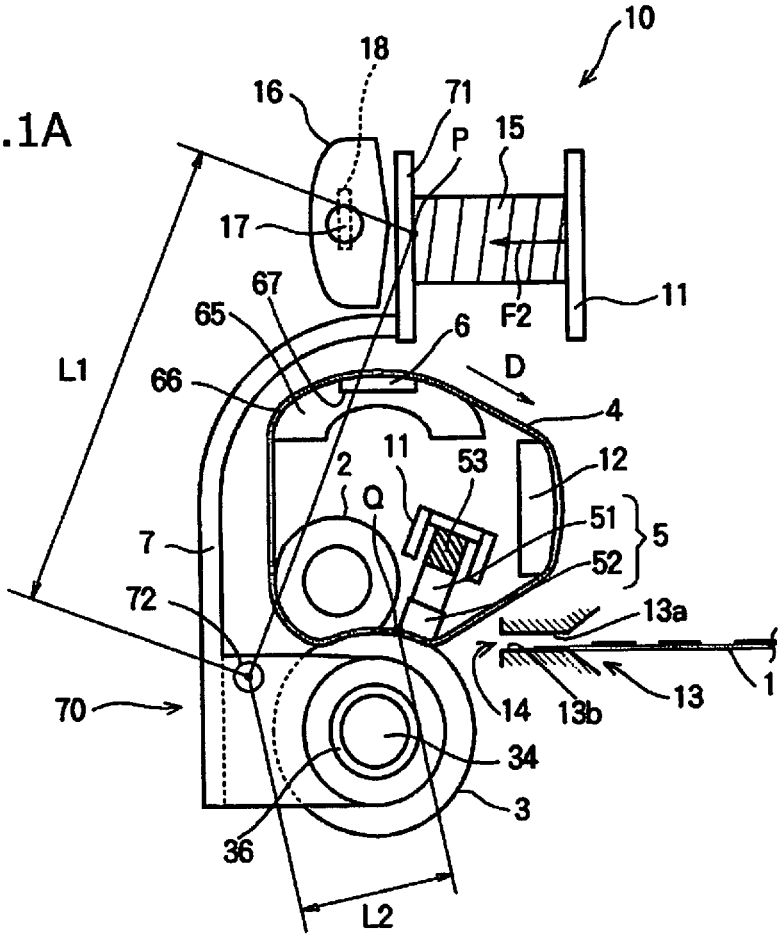
FIGS. 1A and 1B show a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

Configuration of Fixation Device

FIG. 1A is a diagram showing a configuration of fixation device 10 according to a first embodiment of the invention. Fixation device 10 is configured to fix a toner (developer) to medium 1 such as a print sheet, an envelope or a powder paper in image formation apparatus 100 (FIG. 9, to be described later) using electrophotography.

As shown in FIG. 1A, fixation device 10 includes pressure roller 3 as a first roller, fixation roller 2 as a second roller disposed to face pressure roller 3, and fixation belt 4 as a stretch member provided around fixation roller 2 with tension. Here, fixation roller 2 is disposed on the upper side and pressure roller 3 is disposed on the lower side, but the up-down relationship thereof may be reversed.

Inside fixation belt 4, support body 65 to which sheet heater 6 as a heater member is attached, belt guide 12 as a stretcher unit (guide unit) and pressure pad 5 as a press member are disposed in addition to fixation roller 2. These are arranged in a travelling direction (clockwise direction indicated by arrow D) of fixation belt 4, in the order of fixation roller 2, support body 65, belt guide 12 and pressure pad 5.

Figure 1B:
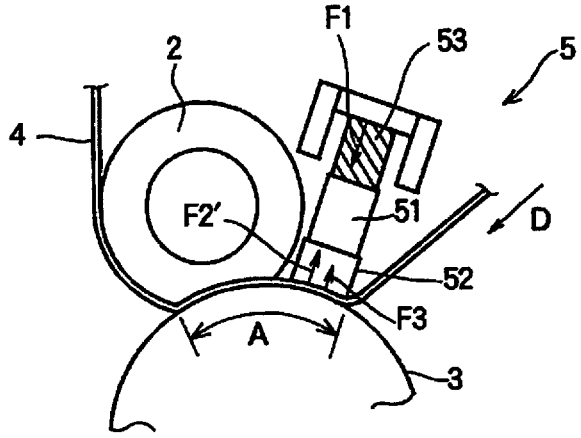

FIG. 1B is an enlarged diagram showing fixation roller 2, pressure roller 3 and pressure pad 5. Pressure pad 5 is disposed upstream of and next to fixation roller 2 in the travelling direction of fixation belt 4. Nip portions are formed between fixation roller 2 and pressure roller 3 as well as between pressure pad 5 and pressure roller 3, respectively.

Pressure pad 5 has an elongated shape which is long in an axial direction of pressure roller 3, and includes core metal 51 and elastic body 52 attached to a front end portion of core metal 51.

Core metal 51 is a pipe or a shaft formed of metal such as aluminum, iron or stainless steel. Elastic body 52 is formed of a high heat-resistant rubber material such as sponge silicone rubber, normal (non-sponge) silicone rubber or fluororubber. In addition, a fluorine-based coating agent having good sliding properties is applied to a surface of elastic body 52.

Additionally, first springs (first bias members) 53 are disposed at equal intervals in a longitudinal direction of pressure pad 5 (axial direction of pressure roller 3), and press elastic body 52 of pressure pad 5 against pressure roller 3. Note that a roller provided with an elastic layer on a surface of the core metal may be used instead of pressure pad 5.

Figure 2A:
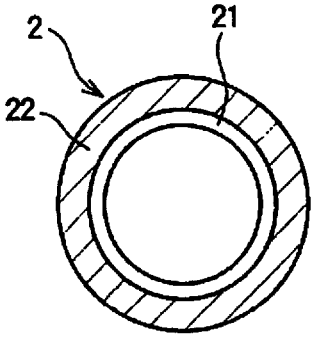
FIGS. 2A and 2B are sectional structures, respectively, of a fixation roller and a pressure roller according to the first embodiment.

FIG. 2A is a diagram showing a sectional structure of fixation roller 2. Fixation roller 2 includes core metal 21 made of metal and elastic layer 22 formed on an outer peripheral surface of core metal 21. Core metal 21 is a pipe or a shaft formed of metal such as aluminum, iron or stainless steel. Elastic layer 22 is formed of a high heat-resistant rubber material such as sponge silicone rubber, normal silicone rubber or fluororubber. A gear is attached to the axial portion of core metal 21, and rotation of fixation drive motor 214 (FIG. 11) is transmitted through a gear train.

Figure 2B:
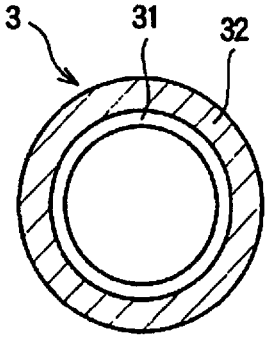

FIG. 2B is a diagram showing a sectional structure of pressure roller 3. Like fixation roller 2, pressure roller 3 includes core metal 31 made of metal and elastic layer 32 formed on an outer peripheral surface of core metal 31. Core metal 31 is a pipe or a shaft formed of metal such as aluminum, iron or stainless steel. Elastic layer 32 is formed of a high heat-resistant rubber material such as sponge silicone rubber, normal silicone rubber or fluororubber. Note that an elastic force of elastic layer 32 of pressure roller 3 is larger than an elastic force of elastic layer 22 of fixation roller 2 (in other words, pressure roller 3 is harder).

Figure 2C:
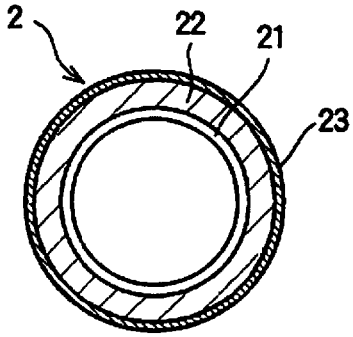
FIG. 2C is a modified example of a fixation roller or a pressure roller according to the first embodiment.

In addition, as shown in FIG. 2C, release layer 23 may be formed on a surface of elastic layer 22 of fixation roller 2. Release layer 23 is formed of resin having high heat resistance and heat conductivity but having low surface free energy after molding, e.g., typical fluorine-based resin such as PTFE (polytetrafluoroethylene), PFA (perfluoro alkoxy alkane), FEP (perfluoro ethylene-propene copolymer) or the like. The thickness of release layer 23 is preferably 10 μm to 50 μm. The same shall apply with regard to pressure roller 3.

Figure 3A:
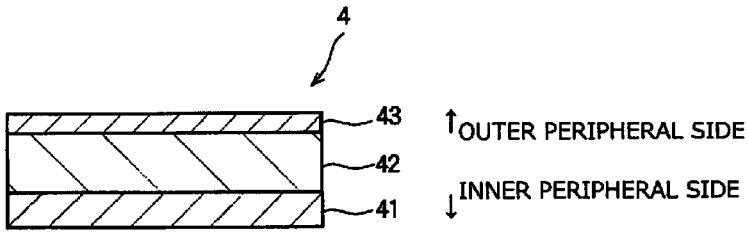
FIG. 3A shows a sectional structure of a fixation belt according to the first embodiment.

FIG. 3A is a diagram showing a sectional structure of fixation belt 4. Fixation belt 4 is an endless belt, and includes substrate 41, elastic layer 42 formed on a surface of substrate 41 and release layer 43 formed on a surface of elastic layer 42. Substrate 41 is located on an inner peripheral side of fixation belt 4, and release layer 43 is located on an outer peripheral side of fixation belt 4.

Substrate 41 is formed of, for example, nickel, polyimide, stainless steel or the like. To achieve both strength and flexibility, the thickness of substrate 41 is preferably 30 μm to 150 μm. Elastic layer 42 is formed of silicone rubber or fluororesin. In the case of silicone rubber, the thickness of elastic layer 42 is preferably 50 μm to 300 μm to achieve both low hardness and high heat conductivity. On the other hand, in the case of fluororesin, the thickness of elastic layer 42 is preferably 10 μm to 50 μm in consideration of high heat conductivity and thinning due to abrasion.

Figure 3B:
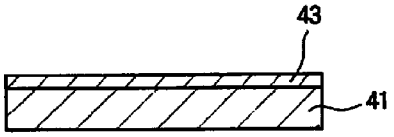
FIG. 3B is a modification thereof.

Release layer 43 is formed of resin having high heat resistance and heat conductivity but having low surface free energy after molding, e.g., typical fluorine-based resin such as PTFE, PFA, FEP or the like. The thickness of release layer 43 is preferably 10 μm to 50 μm. Note that release layer 43 may be directly formed on a surface of substrate 41, as shown in FIG. 3B.

Figure 4A:
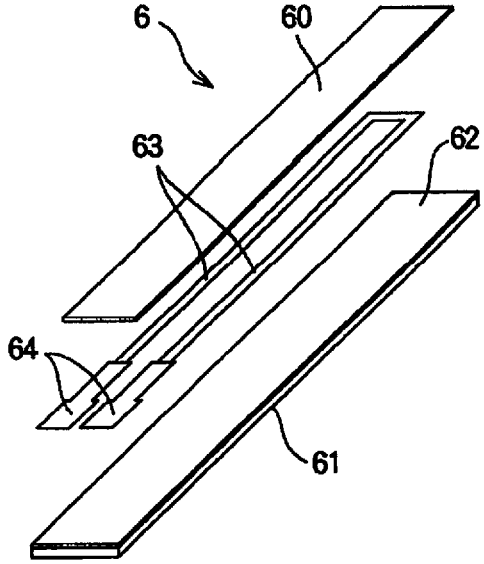
FIGS. 4A and 4B show an exploded perspective view and a plan view, respectively, of a sheet heater according to the first embodiment.
Figure 4C:
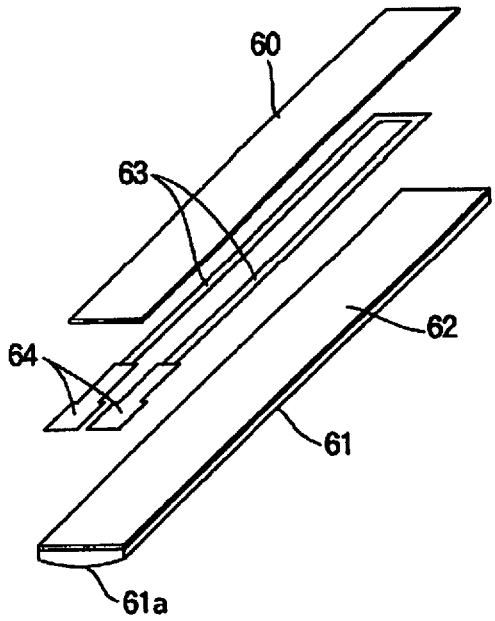
FIG. 4C is a perspective view of a modification of the sheet heater.
Figure 4B:
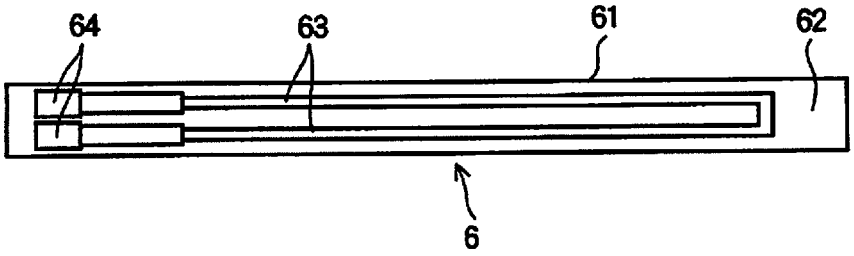

FIGS. 4A and 4B are an exploded perspective view and a plan view, respectively, showing a configuration of sheet heater 6. Sheet heater 6 is, for example, a ceramic heater, a stainless steel heater or the like, and has a flat plate shape or a shape in which a surface in contact with fixation belt 4 is a convex curved surface. Flat plate-shaped sheet heater 6 is shown in FIG. 4A.

In FIG. 4A, sheet heater 6 includes substrate 61, electrical insulation layer 62, resistance heater 63 and electrodes 64. Substrate 61 is made of stainless steel (SUS430) or the like. Electrical insulation layer 62 is made of a thin glass film formed on a surface of substrate 61. Resistance heater 63 is made of a nickel-chrome alloy or a silver-palladium alloy formed on a surface of electrical insulation layer 62 by screen printing or the like. Electrodes 64 are made of metal having high chemical stability such as silver (or metal having high melting point such as tungsten) formed on end portions of resistance heater 63. Moreover, sheet heater 6 is covered with protective layer 60 formed of a typical fluorine-based resin such as PTFE, PFA, or FEP.

In the case of flat plate-shaped sheet heater 6 shown in FIG. 4A, substrate 61 may be in contact with an inner peripheral surface of fixation belt 4, and alternatively, protective layer 60 may be in contact with an inner peripheral surface of fixation belt 4.

Another example of sheet heater 6 is shown in FIG. 4C. In the example shown in FIG. 4C, an opposite surface of substrate 61 from a surface on which resistance heater 63 is formed has convex curved surface (substantially cylindrical surface) 61*a*. Convex curved surface 61*a* comes into contact with an inner peripheral surface of fixation belt 4.

Referring back to FIG. 1A, support body 65 configured to support sheet heater 6 is an elongated member which is long in an axial direction of fixation roller 2. Support body 65 includes convex curved surface (substantially cylindrical surface) 66 which comes into contact with an inner peripheral surface of fixation belt 4. Concave portion (holder) 67 configured to hold sheet heater 6 is formed on curved surface 66. The depth of concave portion 67 is set such that a surface of sheet heater 6 attached to concave portion 67 comes into contact with an inner peripheral surface of fixation belt 4.

Support body 65 is formed of a metal having high heat conductivity and good workability, such as aluminum, copper, and alloy mainly made of these. In addition, support body 65 may be formed of, for example, stainless steel, an iron-based alloy, or iron having high heat resistance and rigidity.

Figure 5:
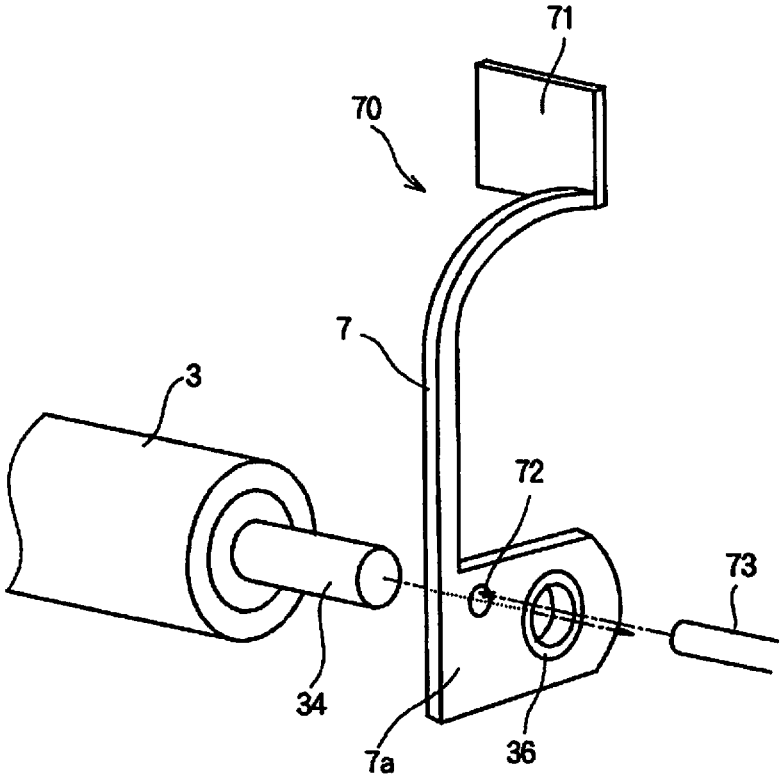
FIG. 5 is a perspective view showing a configuration of a movement mechanism according to the first embodiment.

Pressure roller 3 is held to be rotatable about an axis parallel to a rotation axis of pressure roller 3 by a pair of support plates (supporters) 7. FIG. 5 is a perspective view showing a configuration of movement mechanism 70 including support plates 7.

As shown in FIG. 5, each of bearing portions 36 is attached to a corresponding one of both ends of axial portion 34 of pressure roller 3 to reduce drive torque during rotation. Each bearing portion 36 is attached to a pair of support plates 7 (In FIG. 5, only one of support plates 7 is shown). Each support plate 7 includes hole portion 72 as a rotation fulcrum at a position shifted by a predetermined amount from the center of bearing portion 36. Support shaft 73 provided in frame 11 of fixation device 10 penetrates into hole portion 72 of support plate 7, and then an e ring is fitted to an end portion of support shaft 73. Thereby, support plate 7 is attached to frame 11 of fixation device 10 in such a manner as to be rotatable about a rotation fulcrum (hole portion 72).

Note that since fixation device 10 is attached to apparatus body 101 of image formation apparatus 100 (FIG. 9), support plate 7 is also rotatable relative to apparatus body 101 of image formation apparatus 100.

Support plate 7 extends upward from a portion (bracket portion 7*a*) holding bearing portion 36 of pressure roller 3, and contact portion 71 is formed on an upper end portion of support plate 7. Note that here an upper portion of support plate 7 is curved toward support body 65 (FIG. 1A).

Referring back to FIG. 1A, one end of second spring (second bias member) 15 attached to frame 11 of fixation device 10 is fixed to contact portion 71 of support plate 7. Second spring 15 is configured to bias contact portion 71 of support plate 7 in such a way that support plate 7 rotates about rotation fulcrum (hole portion) 72 in a counterclockwise direction. In other words, second spring 15 is configured to bias support plate 7 in such a direction that pressure roller 3 supported by support plate 7 is pressed against fixation roller 2. Since pressure roller 3 is pressed against fixation roller 2, a nip portion (FIG. 1B) is formed between pressure roller 3 and fixation roller 2.

Here, a distance from the center of rotation fulcrum 72 to point of action P where a biasing force of second spring 15 acts on support plate 7 is referred to as L1. Additionally, a distance from the center of rotation fulcrum 72 to point of action Q where a biasing force of second spring 15 acts on pressure pad 5 through pressure roller 3 is referred to as L2. In the embodiment, support plate 7 is configured to satisfy the relationship L1>L2. In this way, a biasing force of second spring 15 can be effectively transmitted to point of action Q.

Figure 11:
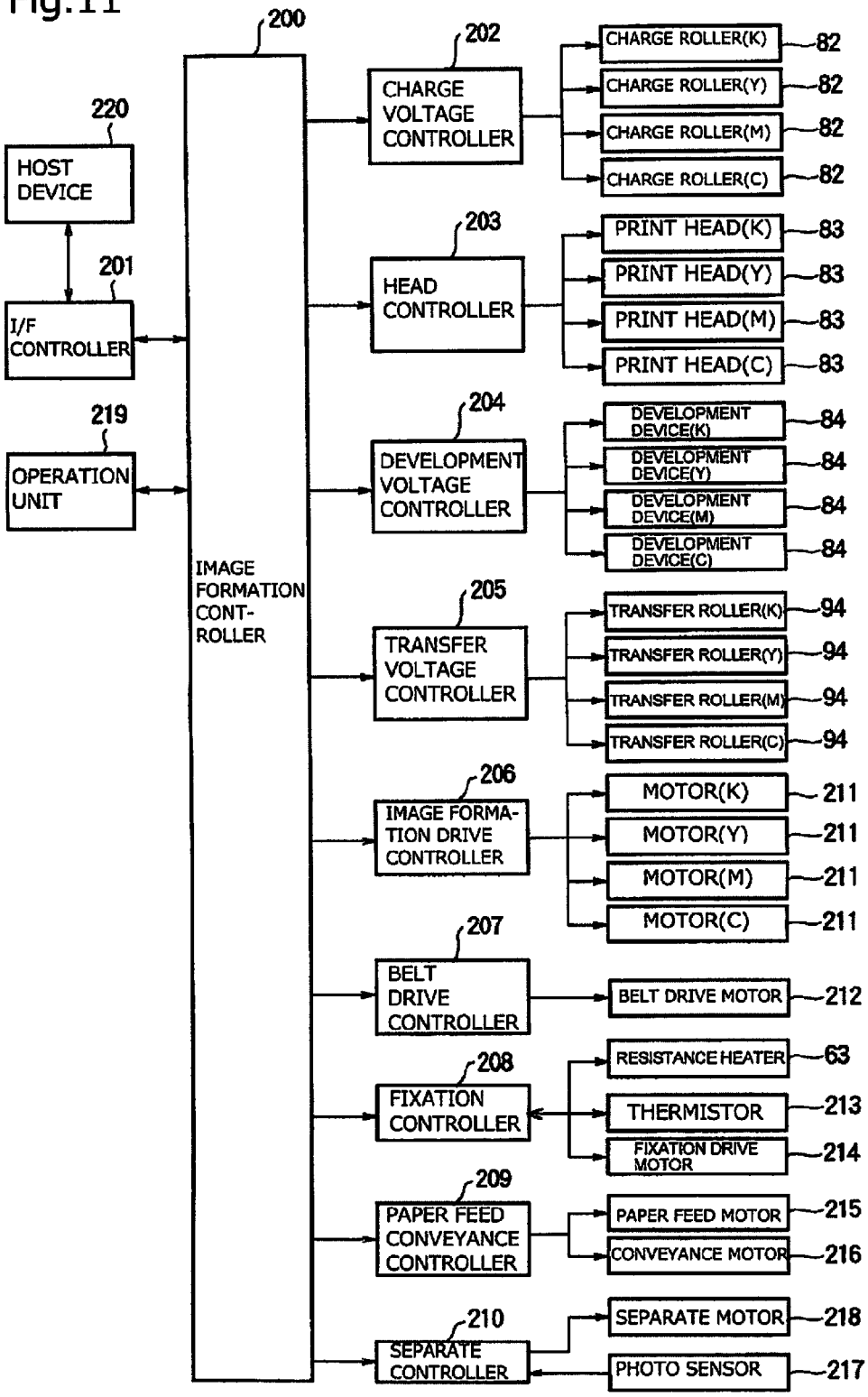
FIG. 11 is a block diagram showing a control system of image formation apparatus 100 in FIG. 9.

Eccentric cam 16 as a drive portion is arranged on the opposite side of contact portion 71 from second spring 15. Eccentric cam 16 is attached with knock pin 18 to rotatable shaft 17 provided on frame 11 of fixation device 10. A rotational position of shaft 17, to which eccentric cam 16 is attached, is controlled by separate motor 218 (FIG. 11).

As described above, fixation belt 4 travels to extend around fixation roller 2, support body 65, belt guide 12 and pressure pad 5. When eccentric cam 16 is located at a rotational position shown in FIG. 1A, eccentric cam 16 is spaced away from contact portion 71 of support plate 7 and support plate 7 does not rotate. In this state, pressure roller 3 is pressed against fixation roller 2 and pressure pad 5, and nip portions are formed between pressure roller 3 and fixation roller 2 as well as between pressure roller 3 and pressure pad 5, respectively (FIG. 1B).

FIG. 6 shows a state where eccentric cam 16 is rotated by a predetermined angle. When eccentric cam 16 rotates by a predetermined angle (for example, 90 degrees) from a state shown in FIG. 1A, eccentric cam 16 comes into contact with contact portion 71 of support plate 7, compresses second spring 15, and rotates support plate 7 about rotation fulcrum (hole portion 72) in a clockwise direction, as shown in FIG. 6. Thereby, pressure roller 3 moves about rotation fulcrum 72 in a clockwise direction, and pressure roller 3 is spaced away from fixation roller 2. Here, pressure roller 3 also moves in such a direction as to be spaced away from pressure pad 5. However, since first spring 53 of pressure pad 5 extends, pressure roller 3 is kept in contact with pressure pad 5 via fixation belt 4 and the pressure (nip pressure) between pressure roller 3 and pressure pad 5 is reduced.

Here, a biasing force generated by first spring 53 is referred to as F1, a biasing force generated by second spring 15 is referred to as F2, and a reaction force received by first spring 53 from fixation belt 4 due to a tension of fixation belt 4 is referred to as F3. Then, in any of the states shown in FIGS. 1A and 6A, the configuration is made to always satisfy the relationship F2>F1>F3.

To be more specific, when a reaction force received by pressure pad 5 from fixation belt 4 due to biasing force F2 of second spring 15 is referred to as F2', the configuration is made to satisfy the relationship F2'>F1>F3.

Figure 7:
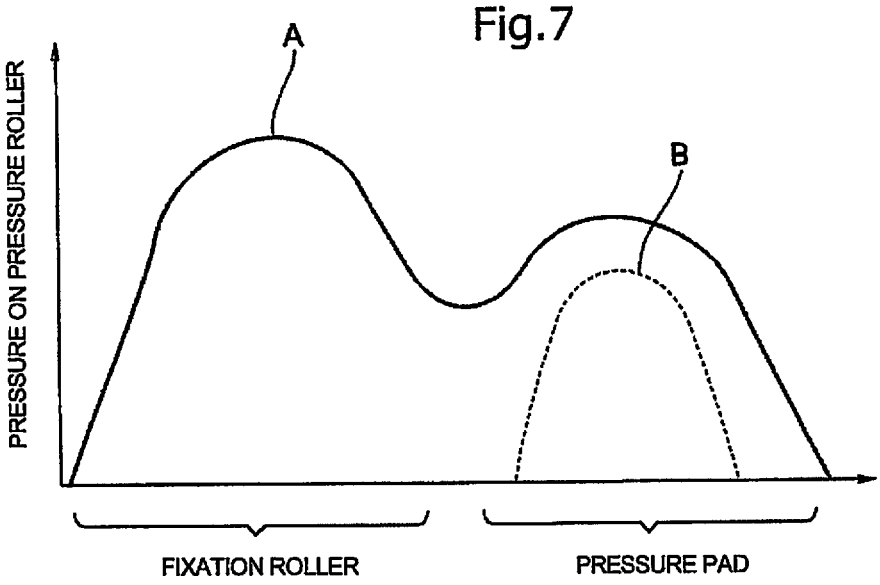
FIG. 7 is a schematic diagram showing a nip pressure between the fixation roller and the pressure roller as well as a nip pressure between a pressure pad and the pressure roller according to the first embodiment.

FIG. 7 is a schematic diagram showing an example of a pressure generated at the nip portion between fixation roller 2 and pressure roller 3 as well as the nip portion between pressure pad 5 and pressure roller 3. In the state of FIG. 1A, because of a biasing force of first spring 53 and a biasing force of second spring 15, a high pressure (nip pressure) is obtained at each of the nip portion between fixation roller 2 and pressure roller 3 as well as the nip portion between pressure pad 5 and pressure roller 3. In other words, as shown by symbol A in FIG. 7, a high nip pressure is obtained in a wide range.

In contrast, in the state shown in FIG. 6, since pressure roller 3 is spaced away from fixation roller 2, the nip pressure becomes 0 (zero) between fixation roller 2 and pressure roller 3, and a nip pressure between pressure pad 5 and pressure roller 3 is also reduced. In other words, as shown by symbol B in FIG. 7, a low nip pressure is obtained in a narrow range.

In the embodiment, when an image is fixed to a normal medium which is unlikely to have wrinkles in fixing, support plate 7 is kept at a position shown in FIG. 1A, and thereby a high nip pressure is generated between fixation roller 2 and pressure roller 3 as well as between pressure pad 5 and pressure roller 3.

Figure 6A:
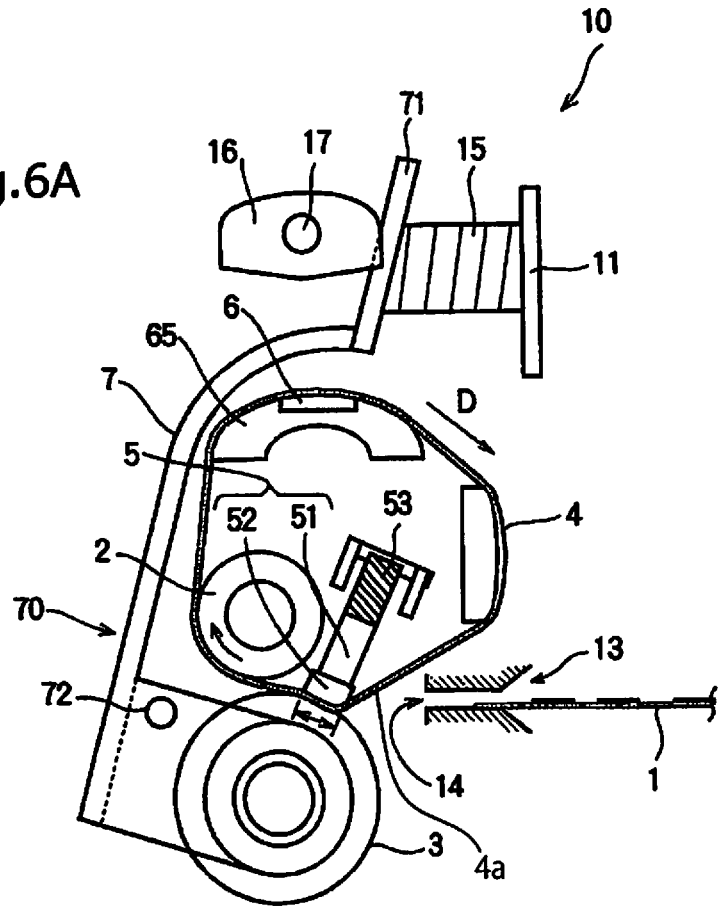
FIGS. 6A and 6B are diagrams showing operations of the fixation device according to the first embodiment.

In contrast, when an image is fixed to a special medium (envelope, powder paper, or the like) or one of specific types of media which is likely to have wrinkles in fixing, eccentric cam 16 is driven by separate motor 218 (FIG. 11), support plate 7 is rotated to a position shown in FIG. 6A, pressure roller 3 is spaced away from fixation roller 2, and a nip pressure between pressure roller 3 and pressure pad 5 is reduced. Note that without being limited to this embodiment, when the thickness of the medium is smaller than a predetermined thickness, pressure roller 3 may be spaced away from fixation roller 2.

Note that as shown in FIG. 1A, medium introducer 13 configured to guide medium 1 to the nip portion between pressure pad 5 and pressure roller 3 is arranged on the right side of the nip portion in the drawing (on the upstream side of the nip portion in a medium conveyance direction. Medium introducer 13 includes upper surface 13*a* and lower surface 13*b* (medium conveyance surfaces 13*a* and 13*b*) respectively corresponding to upper and lower surfaces of medium 1, and includes opening 14 on the nip portion side.

When medium 1 passes through a nip portion, wrinkles in fixing may occur if a speed difference occurs between a print surface (front surface) and a non-print surface (back surface) of medium 1. Accordingly, in the embodiment, in the case of using a special medium or a specific type medium which is likely to have wrinkles in fixing, a low nip pressure is generated with a narrow width as described above. Thereby, the speed difference between the print surface and the non-print surface of medium 1 is reduced to suppress the occurrence of wrinkles in fixing.

That is, medium introducer 13 is provided upstream of the nip portion between pressure roller 3 and pressure pad 5 via fixation belt 4 in the medium conveyance direction. Upper surface 13*a* and lower surface 13*b* of medium introducer 13 functions as medium conveyance surfaces to define the medium conveyance direction in the medium introducer 13. Here, as shown in FIG. 6A, when pressure roller 3 is displaced in such a direction as to be spaced away from fixation roller 2, a travelling path of fixation belt 4 is also displaced and part 4*a* of fixation belt 4 protrudes below lower surface 13*b*, being a reference surface of medium introducer 13 (on the pressure roller 3 side). In other words, the part 4*a* of fixation belt 4 intersects the extended line of medium introducer 13.

Figure 6B:
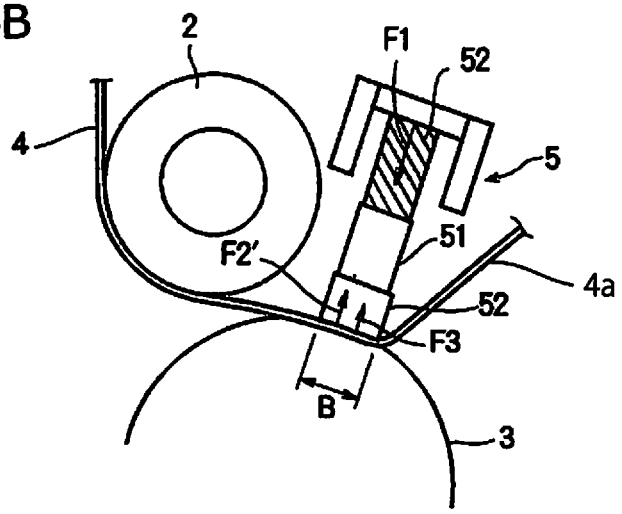

Specifically, as shown in FIGS. 6A and 6B, part 4*a* of fixation belt 4 is an inclined part being inclined with respect to the medium conveyance direction of medium introducer 13 (or, the extended line of medium introducer 13. Inclined part 4*a* is provided downstream of medium introducer 13 in the medium conveyance direction and upstream of the nip between pressure roller 3 and pressure pad 5 via fixation belt 4 in the medium conveyance direction. Inclined part 4*a* is downwardly-inclined toward the downstream side of the medium conveyance direction, that is, inclined part 4*a* is downwardly-inclined toward the nip between pressure roller 3 and pressure pad 5.

Since inclined part 4*a* of fixation belt 4 protrudes below lower surface 13*b*, the medium from medium introducer 13 comes in contact with inclined part 4 of fixation belt 4 before reaching the nip between pressure roller 3 and pressure pad 5 via fixation belt 4.

Figure 8:
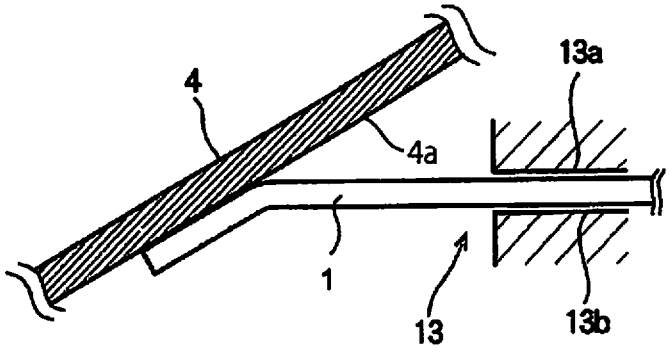
FIG. 8 is a diagram showing a relation between a special medium and the fixation belt.

For this reason, when medium 1 is a special medium or a specific type medium which is likely to have wrinkles in fixing, a leading end portion of medium 1 in the medium conveyance direction comes into contact with fixation belt 4 and is curved along fixation belt 4 upstream of the nip portion between pressure pad 5 and pressure roller 3, as shown schematically in FIG. 8. In other words, medium 1 is conveyed in a state where medium 1 is curved in such a direction as to stretch the print surface (surface on which a toner image is transferred) of medium 1. In this way, since medium 1 is conveyed to a nip portion in a state where medium 1 is curved to stretch wrinkles, the occurrence of wrinkles in fixing is reliably prevented.

Note that a toner (developer) employed in the embodiment is obtained as binding resin by using one or any combination of the following: polystyrene, styrene-propylene copolymer, styrene-vinylnaphthalene copolymer, styrene-methyl acrylate copolymer, polyester-based polymer, polyurethane-based polymer, epoxy-based polymer, aliphatic or cycloaliphatic hydrocarbon resin, or aromatic-based petroleum resin. In addition, wax for preventing offset in fixing, such as polyethylene wax, propylene wax, carnauba wax, or various kinds of ester-based wax, may be contained in the toner, as needed.

<Configuration of Image Formation Apparatus>

Figure 9:
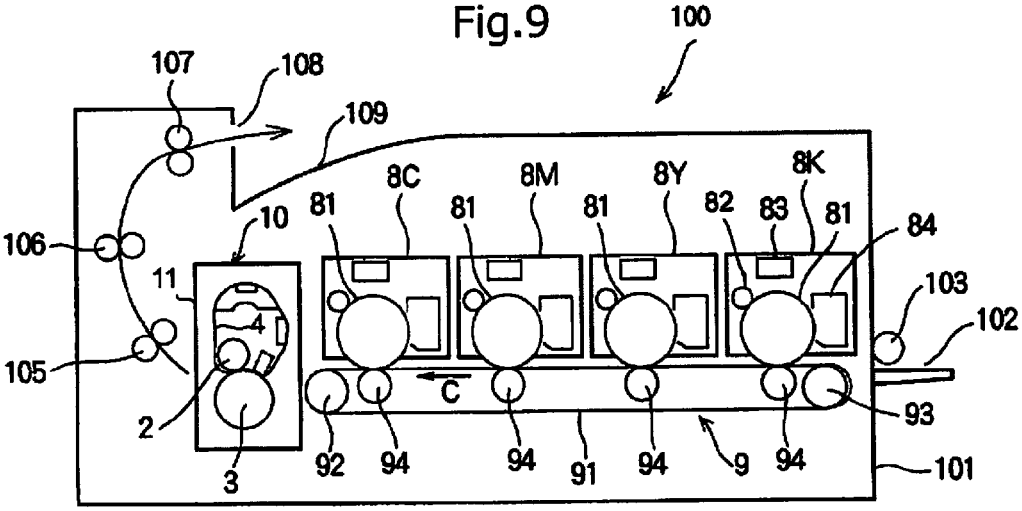
FIG. 9 is a diagram showing a configuration of an image formation apparatus which includes the fixation device according to the first embodiment.

Next, a description is given of image formation apparatus 100 including fixation device 10 according to the first embodiment. FIG. 9 is a diagram showing an example of a configuration of image formation apparatus 100 including fixation device 10 according to the first embodiment. Image formation apparatus 100 is a copier, a printer, a facsimile, an MFP (Multifunction Peripheral) or the like, for example. However, as long as including fixation device 10, image formation apparatus 100 may be an image formation apparatus other than the above ones. In addition, image formation apparatus 100 shown in FIG. 9 is configured to form a color image, but may be configured to form a monochrome image.

Image formation apparatus 100 includes, in its body 101, process units (image formation units) 8K, 8Y, 8M, 8C configured to form a developer image of black, yellow, magenta and cyan. Here, process units 8K, 8Y, 8M, 8C are arranged in a line from right to left in the drawing.

On one side of body 101 (right side in the drawing), medium supplier 102 configured to supply medium 1 (a print sheet, an envelope, a powder paper, or the like) to process units 8K, 8Y, 8M, 8C is provided. Medium supplier 102 is a manual bypass tray into which a user inserts medium 1 by hand or a detachable sheet cassette, for example. In medium supplier 102, pick-up roller 103 configured to feed medium 1 one by one into body 101 is provided. In body 101, a conveyance path of the medium supplied from medium supplier 102 is formed from right to left in the drawing herein.

Next, a description is given of a configuration of process units 8K, 8Y, 8M, 8C. Process units 8K, 8Y, 8M, 8C have the common configuration except for the toner (developer) to be used. Accordingly, a description is given of a configuration of process unit 8K herein.

Figure 10:
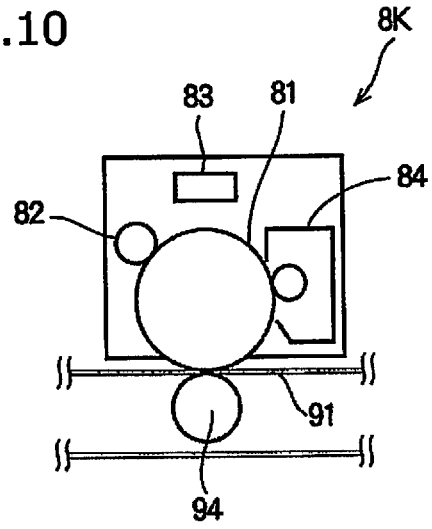
FIG. 10 is a diagram showing a configuration of a process unit of the image formation apparatus in FIG. 9.

FIG. 10 is a diagram showing the configuration of process unit 8K. As shown in FIG. 10, image formation unit 8K includes photosensitive drum 81 as an electrostatic latent image carrier. Photosensitive drum 81 is configured to rotate in a clockwise direction in the drawing. Charge roller 82 as a charge device, print head 83 as an exposure device and development device 84 are disposed in this order in a rotation direction of photosensitive drum 81.

Charge roller 82 is configured to uniformly charge a surface of photosensitive drum 81. Print head 83 includes an LED (light-emitting diode) and is configured to form an electrostatic latent image by exposing the uniformly charged surface of photosensitive drum 81, for example. Development device 84 is configured to develop the electrostatic latent image on the surface of photosensitive drum 81 by using a toner (developer) of a predetermined color and to form a toner image (developer image).

Referring back to FIG. 9, transfer unit 9 is disposed below process units 8K, 8Y, 8M, 8C. Transfer unit 9 includes endless transfer belt 91, drive roller 92 and tension roller 93 around which transfer belt 91 is extended, and four transfer rollers (transfer devices) 94 opposed respectively to photosensitive drums 81 of process units 8K, 8Y, 8M, 8C with transfer belt 91 interposed therebetween.

Drive roller 92 is a drive roller configured to drive transfer belt 91, and tension roller 93 is a driven roller configured to give tension to transfer belt 91. By rotation of drive roller 92, transfer belt 91 holds medium 1 supplied from medium supplier 102, and moves in a direction indicated by arrow C. Each transfer roller 94 is given a transfer voltage for transferring a toner image formed on the surface of each photosensitive drum 81 to medium 1.

Fixation device 10 is disposed downstream (left side in FIG. 1) of image formation units 8K, 8Y, 8M, 8C in the conveyance direction of medium 1.

A group of delivery rollers 105, 106, 107 configured to convey medium 1 having a toner image fixed thereon to delivery port 108 are disposed downstream of fixation device 10. In addition, stacker 109 configured to stack medium 1 delivered from delivery port 108 is disposed on an upper portion of body 101.

FIG. 11 is a block diagram showing a control system of image formation apparatus 100. Image formation controller 200 (or a printer controller) configured to control the entire image formation apparatus 100 includes a microprocessor, a ROM, a RAM, an input/output port, a timer and the like. Image formation controller 200 performs sequential control of the image formation apparatus by receiving print data and control commands from host device 220 such as a personal computer.

I/F controller 201 transmits information (such as printer information) on image formation apparatus 100 to host device 220, and analyzes commands transmitted from host device 220. Additionally, I/F controller 201 processes data transmitted from host device 220.

In response to an instruction from image formation controller 200, charge voltage controller 202 performs control to apply a charge voltage to each charge roller 82 of process units 8K, 8Y, 8M, 8C in order to uniformly charge a surface of each photosensitive drum 81 of process units 8K, 8Y, 8M, 8C.

In response to an instruction from image formation controller 200, head controller 203 performs control to drive each print head 83 of process units 8K, 8Y, 8M, 8C based on print data in order to form an electrostatic latent image by exposing a surface of each photosensitive drum 81.

In response to an instruction from image formation controller 200, development voltage controller 204 performs control to apply a development voltage to each development device 84 of process units 8K, 8Y, 8M, 8C in order to develop the electrostatic latent image formed on the surface of each photosensitive drum 81.

In response to an instruction from image formation controller 200, transfer voltage controller 205 performs control to apply a transfer voltage to each transfer roller 94 in order to transfer a toner image formed on the surface of each photosensitive drum 81 to medium 1.

In response to an instruction from image formation controller 200, image formation drive controller 206 performs control to drive motor 211 provided for each of process units 8K, 8Y, 8M, 8C in order to rotationally drive photosensitive drum 81, charge roller 82 and a development roller of development device 84.

In response to an instruction from image formation controller 200, belt drive controller 207 performs control to drive belt drive motor 212 in order to drive transfer belt 91 by rotating drive roller 92. Note that transfer belt 91, tension roller 93 and transfer roller 94 are also driven rotationally together with the drive of drive roller 92.

Fixation controller 208 receives a detection temperature from thermistor 213 configured to detect a temperature of fixation device 10, and performs control to turn on and off electricity to sheet heater 6 of fixation device 10. In response to an instruction from image formation controller 200, fixation controller 208 also performs control to drive fixation drive motor 214 configured to rotate fixation roller 2 of fixation device 10. Note that pressure roller 3 and fixation belt 4 in contact with fixation roller 2 are driven rotationally with fixation roller 2.

In response to an instruction from image formation controller 200, paper feed conveyance controller 209 performs control to drive paper feed motor 215 and conveyance motor 216 in order to feed and convey medium 1. Paper feed motor 215 rotationally drives pick-up roller 103, and conveyance motor 216 rotationally drives delivery roller pairs 105, 106, 107.

In response to an instruction from image formation controller 200, separate controller 210 drives separate motor 218 to rotate eccentric cam 16, and moves pressure roller 3 in such a direction that pressure roller 3 comes close to or is spaced away from fixation roller 2 and pressure pad 5. Note that separate controller 210 performs control to drive separate motor 218 based on a detection signal of photo sensor 217 configured to detect the rotational position of support plate 7.

Operation unit 219 with which a user inputs a type of medium 1 is connected to image formation controller 200. On the basis of a type of medium 1 inputted by a user from operation unit 219, image formation controller 200 determines: whether pressure roller 3 is to be pressed against fixation roller 2 and pressure pad 5; or whether pressure roller 3 is to be spaced away from fixation roller 2. Image formation controller 200 then provides instructions to separate controller 210.

<Operations of Image Formation Apparatus>

Next, basic operations of image formation apparatus 100 are described with reference to FIGS. 9 to 11. First, a user selects one of a special medium (medium, such as an envelope or a powder paper, which is likely to have wrinkles in fixing) and a normal medium (non-special medium) as a type of medium 1 in operation unit 219 (FIG. 11). Image formation controller 200 determines a type of medium 1 based on the input from operation unit 219.

Subsequently, image formation controller 200 receives print instructions and print data from host device 220, and starts image formation operations. First, paper feed motor 215 is driven by paper feed conveyance controller 209, and pick-up roller 103 rotates and feeds medium 1 on medium supplier 102 one by one to process units 8K, 8Y, 8M, 8C.

Moreover, belt drive motor 212 is driven by belt drive controller 207 to rotate drive roller 92. Thereby, medium 1 supplied from medium supplier 102 is suctioned and held by transfer belt 91 to be conveyed along process units 8K, 8Y, 8M, 8C.

In process units 8K, 8Y, 8M, 8C, charge roller 82 to which a charge voltage is applied from charge voltage controller 202 uniformly charges a surface of photosensitive drum 81. Furthermore, print head 83 is driven by head controller 203, and the surface of photosensitive drum 81 is exposed in accordance with image information to form an electrostatic latent image. In addition, a development voltage is applied to development device 84 by develop voltage controller 204, and the electrostatic latent image on the surface of photosensitive drum 81 is developed by using a toner to form a toner image.

A transfer voltage is applied to each transfer roller 94 of transfer belt unit 9 by transfer voltage controller 205, and the toner image on the surface of photosensitive drum 81 of each of process units 8Y, 8M, 8C, 8K is transferred to medium 1 on transfer belt 91.

Medium 1 to which a toner image is transferred is conveyed to fixation device 10. In fixation device 10, heat and pressure are applied to a toner image on medium 1, and the toner image is fixed to medium 1. Operations of fixation device 10 are described later. Medium 1 to which a toner image is fixed is conveyed by delivery roller pairs 105, 106, 107, and is delivered from delivery port 107 to stacker 109. In this way, image formation onto medium 1 is completed.

<Operations of Fixation Device>

Next, a description is given of operations of fixation device 10. When power of image formation apparatus 100 is turned on, fixation controller 208 turns on electricity to sheet heater 6 in response to an instruction from image formation controller 200 so that sheet heater 6 generates Joule heat. The heat generated by sheet heater 6 is transmitted to fixation roller 2 through fixation belt 4, and is further transmitted to pressure roller 3 and pressure pad 5 as well. Note that on the basis of the temperature in fixation device 10 detected by thermistor 213, fixation controller 208 performs control to turn on and off electricity to sheet heater 6 to keep the temperature of fixation belt 4 constant.

On the basis of the input from operation unit 219, image formation controller 200 determines a type of medium 1 (special medium or not). When medium 1 is a normal medium (non-special medium), image formation controller 200 keeps eccentric cam 16 at a position shown in FIG. 1A and keeps pressure roller 3 pressed against fixation roller 2, and does not reduce a nip pressure between pressure pad 5 and pressure roller 3. In this case, a high nip pressure occurs at both of a nip portion between fixation roller 2 and pressure roller 3, and a nip portion between pressure pad 5 and pressure roller 3.

On the other hand, when medium 1 is a special medium (an envelope, a thin paper, a powder paper, or the like) which is likely to have wrinkles in fixing, separate motor 218 is driven by separate controller 210 to rotate eccentric cam 16 from a position shown in FIG. 1A to a position shown in FIG. 6A and thereby eccentric cam 16 presses contact portion 71 of support plate 7. Accordingly, support plate 7 is rotated in a clockwise direction in the drawing, and thus pressure roller 3 is spaced away from fixation roller 2 as well as a nip pressure between pressure roller 3 and pressure pad 5 is reduced. In this case, no nip portion is formed between fixation roller 2 and pressure roller 3, and a nip portion is only formed between pressure pad 5 and pressure roller 3. In other words, a low nip pressure occurs in a narrow range.

In this state, fixation controller 208 drives fixation drive motor 214, and fixation roller 2 rotates in a clockwise direction in the drawing. Along with rotation of fixation roller 2, fixation belt 4 extending around fixation roller 2 travels in the same direction (shown by symbol D). In addition, pressure roller 3 pressed against fixation roller 2 rotates in a counterclockwise direction in the drawing.

Medium 1 carrying a toner image transferred onto its upper surface in process units 8K, 8Y, 8M, 8C passes through medium introducer 13 and reaches a nip portion between pressure pad 5 and pressure roller 3.

In the case of a normal medium, a nip portion is formed between pressure pad 5 and pressure roller 3 as well as between fixation roller 2 and pressure roller 3. For this reason, medium 1 passes through a wide nip portion and is given heat and a high pressure for a relatively long time. Thereby, a toner is melted and fixed to a surface of medium 1.

On the other hand, in the case of a special medium, a nip portion is only formed between pressure pad 5 and pressure roller 3. For this reason, medium 1 passes through a narrow nip portion and is given heat and a low pressure for a relatively short time. Thereby, a toner is melted and fixed to a surface of medium 1.

When medium 1 passes through a nip portion, wrinkles in fixing may occur if a speed difference occurs between a print surface and a non-print surface of medium 1. Accordingly, in the embodiment, in the case of using a special medium which is likely to have wrinkles in fixing, a low nip pressure is generated with a narrow width. Thereby, the speed difference between the print surface and the non-print surface of medium 1 is reduced to suppress the occurrence of wrinkles in fixing.

<Effects>

As described above, in fixation device 10 according to the first embodiment, in the case of using a special medium, the width of a nip portion (nip width) is made narrower than that in the case of using a normal medium. Thereby, the speed difference between the print surface and the non-print surface of the special medium is reduced to prevent the occurrence of wrinkles in fixing, which is attributable to the speed difference.

In addition, even after fixation roller 2 and pressure roller 3 are spaced away from each other, pressure pad 5 is pressed against pressure roller 3 by first spring 53. Hence, a narrow nip portion (nip portion between pressure pad 5 and pressure roller 3) can be formed. Accordingly, even in this state, an image can be fixed to medium 1.

Additionally, even after fixation roller 2 and pressure roller 3 are spaced away from each other, pressure pad 5 is pressed against pressure roller 3 from an inner side of fixation belt 4. Hence, a tension of fixation belt 4 is maintained and friction between fixation belt 4 and fixation roller 2 can be secured. For this reason, rotation torque of fixation roller 2 is transmitted to fixation belt 4, and thus fixation belt 4 can travel. Accordingly, a conveyance force of fixation belt 4 can be secured to convey medium 1 to a downstream position of fixation device 10 (for example, to delivery roller 105).

Moreover, a user sets (selects) in advance a type of the medium (an envelope, a thin paper, a powder paper, or the like). Accordingly, on the basis of the setting, image formation controller 200 can select any one of a first operation state where pressure roller 3 is pressed against fixation roller 2 and pressure pad 5, and a second operation state where pressure roller 3 is spaced away from fixation roller 2 and a nip pressure between pressure pad 5 and pressure roller 3 is reduced.

Furthermore, along with movement of pressure roller 3, part of fixation belt 4 protrudes below medium introducer 13 (on the pressure roller 3 side). Accordingly, wrinkles near a leading end of a special medium passing through medium introducer 13 can be curved to be stretched along fixation belt 4, and thus the occurrence of wrinkles in fixing can be prevented reliably.

Second Embodiment

Configuration of Fixation Device

Figure 12:
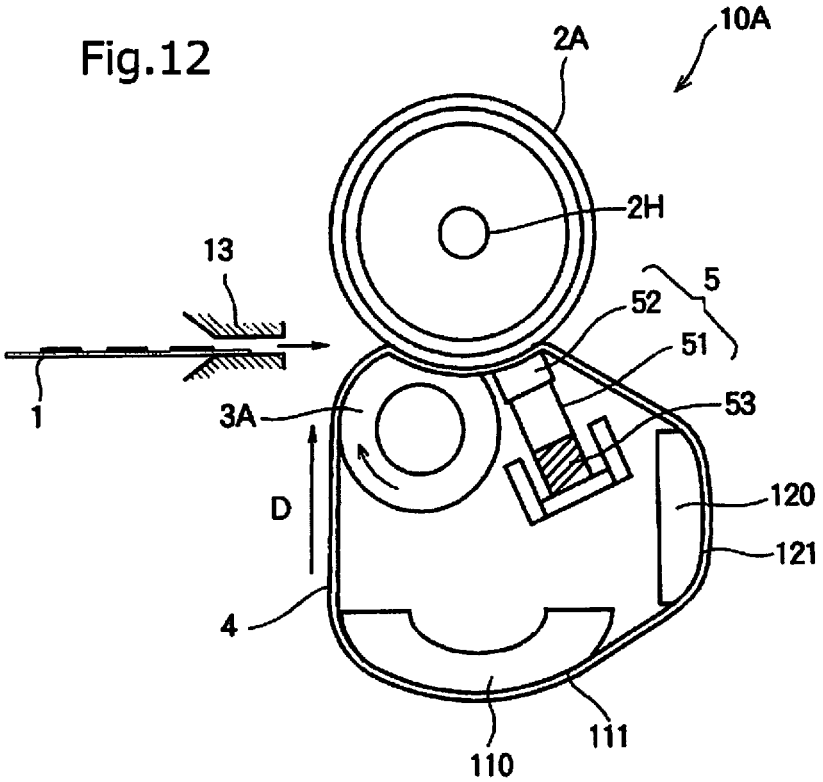
FIG. 12 is a diagram showing a fixation device according to a second embodiment of the invention.

FIG. 12 is a diagram showing a configuration of fixation device 10A according to a second embodiment of the invention. Note that in the second embodiment, the same components as those in the first embodiment are denoted by the same reference numerals.

As shown in FIG. 12, fixation device 10A according to the second embodiment includes fixation roller 2A as a first roller, pressure roller 3A as a second roller disposed to face fixation roller 2A, and fixation belt 4 as a stretch member provided around pressure roller 3A with tension. Sheet heater 6 (FIG. 1) described in the first embodiment is not provided, and halogen lamp 2H as a heater member is provided inside fixation roller 2A. Here, fixation roller 2A is disposed on the upper side and pressure roller 3A is disposed on the lower side, but the up-down relationship thereof may be reversed.

Inside fixation belt 4, pressure pad 5 as a press member, first belt guide 110 as a first stretcher unit and second belt guide 120 as a second stretcher unit are provided in addition to pressure roller 3A. These are arranged in a travelling direction of fixation belt 4 (arrow D), in the order of pressure roller 3A, pressure pad 5, second belt guide 120 and first belt guide 110.

Pressure pad 5 is disposed downstream of and next to pressure roller 3A in the travelling direction of fixation belt 4. Nip portions are formed between pressure roller 3A and fixation roller 2A as well as between pressure pad 5 and fixation roller 2A, respectively.

First belt guide 110 and second belt guide 120 respectively include curved outer surfaces 111, 121 being in contact with an inner peripheral surface of fixation belt 4. First belt guide 110 is disposed upstream of pressure roller 3A in the travelling direction of fixation belt 4. Second belt guide 120 is disposed downstream of pressure pad 5 in the travelling direction of fixation belt 4.

Figure 13A:
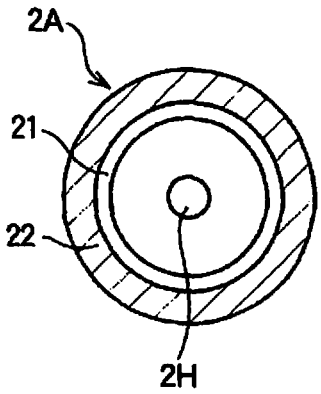
FIGS. 13A and 13B show the second embodiment.

FIG. 13A is a diagram showing a sectional structure of fixation roller 2A. Fixation roller 2A according to the second embodiment includes halogen lamp 2H as a heat source. Halogen lamp 2H is surrounded by core metal 21 made of metal, and elastic layer 22 is formed on an outer peripheral surface of core metal 21. Core metal 21 is a pipe or a shaft formed of metal such as aluminum, iron or stainless steel. Elastic layer 22 is formed of a high heat-resistant rubber material such as sponge silicone rubber, normal silicone rubber or fluororubber. Note that unlike the first embodiment, no gear is attached to the axial portion of core metal 21.

Figure 13B:
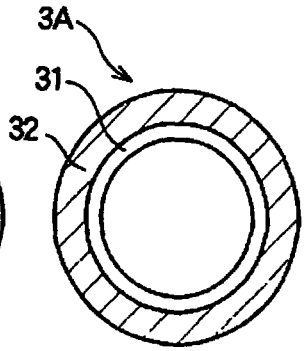

FIG. 13B is a diagram showing a sectional structure of pressure roller 3A. Like pressure roller 3 according to the first embodiment, pressure roller 3A includes core metal 31 made of metal, and elastic layer 32 formed on an outer peripheral surface of core metal 31. Core metal 31 is a pipe or a shaft formed of metal such as aluminum, iron or stainless steel. Elastic layer 32 is formed of a high heat-resistant rubber material such as sponge silicone rubber, normal silicone rubber or fluororubber.

Note that an elastic force of elastic layer 32 of pressure roller 3A is smaller than an elastic force of elastic layer 22 of fixation roller 2A (in other words, fixation roller 2A is harder).

In addition, drive gear 38 (FIG. 16) as a first drive transmitter is attached to axial portion 34 (FIG. 15) of pressure roller 3A. Rotation transmission to drive gear 38 is described later.

Figure 13C:
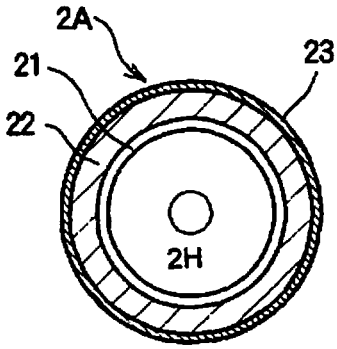
FIG. 13C shows a modification of the fixation roller or the pressure roller according to the second embodiment.

Note that as shown in FIG. 13C, release layer 23 may be formed on a surface of elastic layer 22 of fixation roller 2A. Release layer 23 is formed of resin having high heat resistance and heat conductivity but having low surface free energy after molding, e.g., typical fluorine-based resin such as PTFE, PFA, FEP or the like. The thickness of release layer 23 is preferably 10 μm to 50 μm. The same shall apply with regard to pressure roller 3A.

Figure 14A:
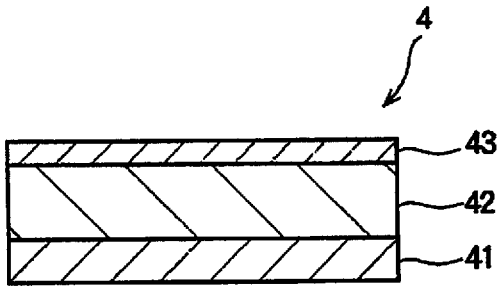
FIG. 14A shows a sectional structure of a fixation belt according to the second embodiment.

FIG. 14A is a diagram showing a sectional structure of fixation belt 4. As described in the first embodiment, fixation belt 4 includes substrate 41, elastic layer 42 and release layer 43. Substrate 41 is located on an inner peripheral side of fixation belt 4, and release layer 43 is located on an outer peripheral side of fixation belt 4.

Figure 14B:
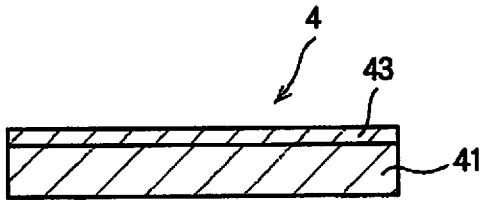
FIG. 14B is a diagram showing a modification thereof.

Substrate 41 is formed of, for example, nickel, polyimide, stainless steel or the like. To achieve both strength and flexibility, the thickness of substrate 41 is preferably 30 μm to 150 μm. Elastic layer 42 is formed of silicone rubber or fluororesin. In the case of silicone rubber, the thickness of elastic layer 42 is preferably 50 μm to 300 μm to achieve both low hardness and high heat conductivity. On the other hand, in the case of fluororesin, the thickness of elastic layer 42 is preferably 10 μm to 50 μm in consideration of high heat conductivity and thinning due to abrasion. Release layer 43 is formed of resin having high heat resistance and heat conductivity but having low surface free energy after molding, e.g., typical fluorine-based resin such as PTFE, PFA, FEP or the like. The thickness of release layer 43 is preferably 10 μm to 50 μm. Note that release layer 43 may be directly formed on a surface of substrate 41, as shown in FIG. 14B.

Referring back to FIG. 12, as described in the first embodiment, pressure pad 5 includes core metal 51 made of metal and elastic body 52 attached to a front end portion of core metal 51. Core metal 51 is a pipe or a shaft formed of metal such as aluminum, iron or stainless steel. Elastic body 52 is formed of a high heat-resistant rubber material such as sponge silicone rubber, normal silicone rubber or fluororubber. In addition, a fluorine-based coating agent having good sliding properties is applied to a surface of elastic body 52.

Additionally, first springs 53 are disposed with equal intervals in a longitudinal direction of pressure pad 5 (axial direction of pressure roller 3A), and press a front end (elastic body 52) of pressure pad 5 against fixation roller 2A. Note that a roller provided with an elastic layer on a surface of the core metal may be used instead of pressure pad 5.

Figure 15:
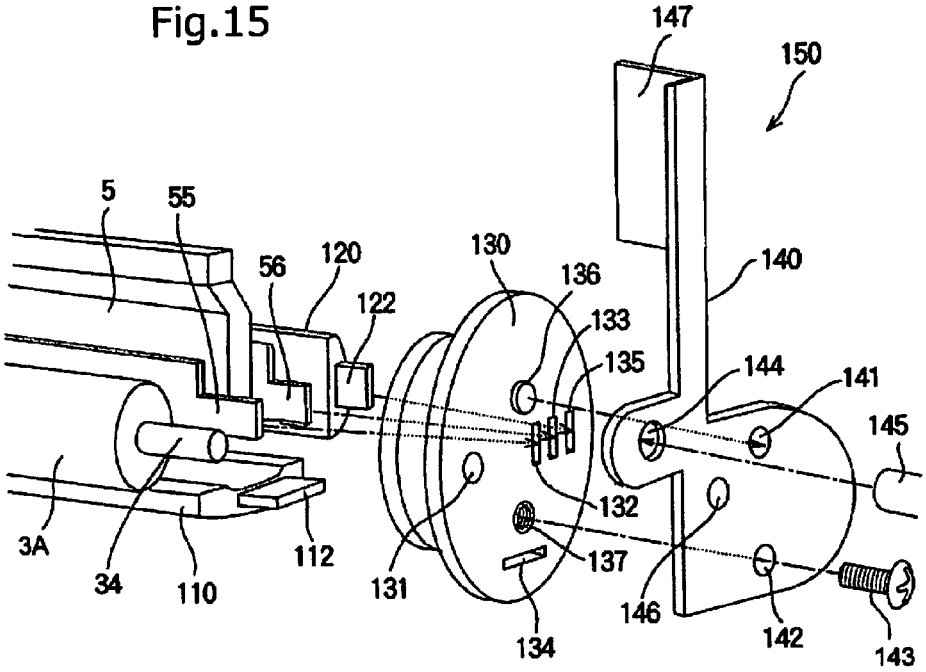
FIG. 15 is a perspective view showing part of a mechanism of the fixation device according to the second embodiment.

FIG. 15 is a perspective view showing part of a mechanism of fixation device 10A. Pressure roller 3A, pressure pad 5, first belt guide 110 and second belt guide 120 are installed in a pair of flange portions 130 (only one flange portion 130 is shown in FIG. 15) disposed on both ends of pressure roller 3A in the axial direction thereof.

Axial portion 34 of pressure roller 3A is installed by being rotatably engaged to circular hole 131 formed in each flange portion 130. A pair of fit portions 55, 56 formed protruding at each end portion of pressure pad 5 in the longitudinal direction are installed in flange portion 130 by being fitted to fit holes 132, 133 formed in flange portion 130. Fit portion 112 formed protruding at an end surface of first belt guide 110 is fitted to fit hole 134 formed in flange portion 130, and thus first belt guide 110 is installed in flange portion 130. Fit portion 122 formed protruding at an end surface of second belt guide 120 is fitted to fit hole 135 formed in flange portion 130, and thus second belt guide 120 is installed in flange portion 130.

Support plate 140 is provided at an outer side of each flange portion 130 in the axial direction of pressure roller 3A. Support plate 140 includes fit hole 141 configured to engage with protrusion portion 136 formed protruding at an outer surface of flange portion 130. In addition, support plate 140 includes hole 142 at a position corresponding to screw hole 137 formed in flange portion 130. Screw 143 is screwed into screw hole 137 through hole 142, and thus flange portion 130 is fixed to support plate 140.

Engagement hole 144 configured to engage with support shaft (rotation fulcrum) 145 formed in frame 11 of fixation device 10A is formed in support plate 140. Support shaft 145 penetrates into engagement hole 144 of support plate 140 and is fixed by using an e-ring, and thus support plate 140 is rotatably attached to frame 11 of fixation device 10A.

Support plate 140 also includes hole 146 corresponding to hole 131 (hole to which axial portion 34 of pressure roller 3A is attached) of flange portion 130. Axial portion 34 of pressure roller 3A penetrates hole 131 of flange portion 130 and hole 146 of support plate 140, and drive gear 38 (FIG. 16) is attached to an end portion of axial portion 34. Drive gear 38 is engaged with transmission gear 148 (FIG. 16) as a second drive transmitter, which is provided coaxially with rotation support shaft 145 to support plate 140. Rotation of fixation drive motor 214 (FIG. 11) described in the first embodiment is transmitted to transmission gear 148.

Only one flange portion 130 and only one support plate 140 are shown in FIG. 15. However, each of flange portion 130 and support plate 140 is provided at both ends of pressure roller 3A in the axial direction, so as to support pressure roller 3A, pressure pad 5, first belt guide 110 and second belt guide 120.

Support plate 140 includes contact portion 147 configured to come into contact with eccentric cam 16 (FIG. 16) near an upper end of support plate 140. Second spring 15 (FIG. 16) is provided on the opposite side of contact portion 147 from eccentric cam 16. Configurations of eccentric cam 16 and second spring 15 are described above in the first embodiment.

In the above configuration, flange portion 130, support plate 140, eccentric cam 16 and separate motor 218 form a movement mechanism configured to move pressure roller 3A in such a direction that pressure roller 3A comes into contact with (or comes close to) fixation roller 2A and in a direction opposite thereto (pressure roller 3A is spaced away from fixation roller 2A). In addition, pressure roller 3A, pressure pad 5, drive gear 38, transmission gear 148, first belt guide 110, second belt guide 120, flange portion 130 and support plate 140 form contact member unit 150 (FIG. 15).

Note that in the second embodiment, medium 1 is introduced into a space (nip portion) between fixation roller 2A and pressure roller 3A from the left side in FIG. 12. Other configurations of fixation device 10A and image formation apparatus 100 are described above in the first embodiment.

<Operations of Fixation Device>

Next, operations of fixation device 10A are described with reference to FIG. 12 and FIG. 16. Note that a control system shown in FIG. 11 is referred to as needed. When power of image formation apparatus 100 is turned on, fixation controller 208 performs control to turn on electricity to halogen lamp 2H of fixation roller 2A in response to an instruction from image formation controller 200 (FIG. 11) so that halogen lamp 2H generates Joule heat. Heat of fixation roller 2A is transmitted to pressure roller 3A and pressure pad 5 through fixation belt 4. Note that on the basis of the temperature in fixation device 10A detected by thermistor 213, fixation controller 208 performs control to turn on and off electricity to halogen lamp 2H to keep the temperature of fixation belt 4 constant.

On the basis of the input from operation unit 219 described in the first embodiment, image formation controller 200 determines whether or not medium 1 is a special medium. When medium 1 is a normal medium (non-special medium), image formation controller 200 keeps eccentric cam 16 at a position shown in FIG. 12 and keeps pressure roller 3A pressed against fixation roller 2A, and does not reduce a nip pressure between pressure pad 5 and fixation roller 2A. In this case, a high nip pressure occurs at both of a nip portion between pressure roller 3A and fixation roller 2A, and a nip portion between pressure pad 5 and fixation roller 2A.

Figure 16:
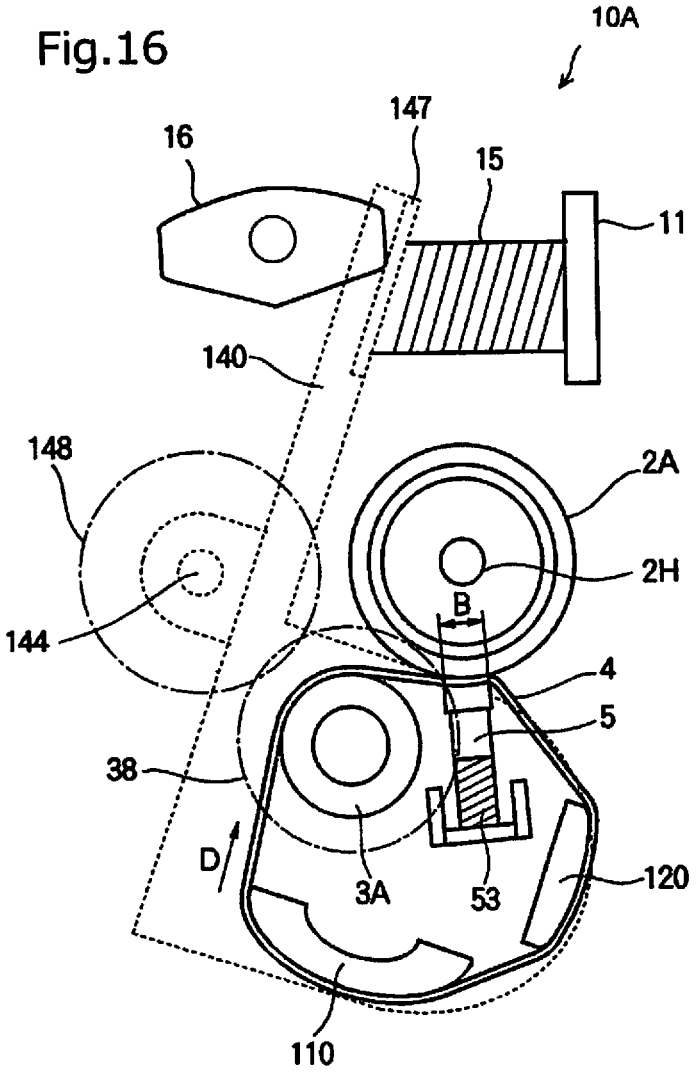
FIG. 16 is a diagram showing operations of the fixation device according to the second embodiment.

On the other hand, when medium 1 is a special medium (an envelope, a thin paper, a powder paper, or the like) which is likely to have wrinkles in fixing, separate motor 218 is driven by separate controller 210 to rotate eccentric cam 16 from a position shown in FIG. 12 to a position shown in FIG. 16. Thereby, eccentric cam 16 presses contact portion 147 of support plate 140, and support plate 140 is rotated in a clockwise direction in the drawing. Hence, pressure roller 3A is spaced away from fixation roller 2A, and a nip pressure between pressure pad 5 and fixation roller 2A is reduced. In this case, no nip portion is formed between pressure roller 3A and fixation roller 2A, and a nip portion is only formed between pressure pad 5 and fixation roller 2A. In other words, a low nip pressure occurs in a narrow range.

In this state, fixation controller 208 drives fixation drive motor 214, and rotation of fixation drive motor 214 is transmitted to pressure roller 3A through transmission gear 148 and drive gear 38. Pressure roller 3A rotates in a clockwise direction in the drawing, and fixation belt 4 extending around pressure roller 3A travels in the same direction (shown by symbol D). In addition, fixation roller 2A pressed against pressure roller 3A rotates in a counterclockwise direction in the drawing. Medium 1 passes through medium introducer 13 and reaches a nip portion between pressure roller 3A and fixation roller 2A.

In the case of a normal medium, a nip portion is formed between pressure roller 3A and fixation roller 2A as well as between pressure pad 5 and fixation roller 2A. For this reason, medium 1 passes through a wide nip portion and is given heat and a high pressure for a relatively long time. Thereby, a toner is melted and fixed to a surface of medium 1.

On the other hand, in the case of a special medium, a nip portion is only formed between pressure pad 5 and fixation roller 2A. Thereby, medium 1 passes through a narrow nip portion and is given heat and a low pressure for a relatively short time. Thereby, a toner is melted and fixed to a surface of medium 1. In addition, since the speed difference between the print surface and the non-print surface of medium 1 can be reduced, the occurrence of wrinkles in fixing can be suppressed.

As described above, in fixation device 10A according to the second embodiment as well, in the case of using a special medium, the width of a nip portion is made narrower than that in the case of using a normal medium. Thereby, the speed difference between the print surface and the non-print surface of the special medium can be reduced to prevent the occurrence of wrinkles in fixing, which is attributable to the speed difference.

In particular, even after fixation roller 2A and pressure roller 3A are spaced away from each other, pressure pad 5 is pressed against fixation roller 2A. Hence, a narrow nip portion can be formed. Accordingly, even in this state, an image can be fixed to medium 1.

Additionally, even after fixation roller 2A and pressure roller 3A are spaced away from each other, pressure pad 5 is pressed against fixation roller 2A from an inner side of fixation belt 4. Hence, a tension of fixation belt 4 is maintained and friction between fixation belt 4 and fixation roller 2A can be secured. For this reason, rotation torque of pressure roller 3A is transmitted to fixation belt 4, and thus a conveyance force of fixation belt 4 to convey medium 1 can be secured.

Note that in the above embodiments, on the basis of an operation performed by a user in operation unit 219, image formation controller 200 determines whether medium 1 is a special medium or a normal medium, but the embodiments are not limited thereto. For example, host device 220 such as a personal computer makes a setting of whether medium 1 is a special medium or a normal medium, and image formation controller 200 may acquire information as to whether medium 1 is a special medium or a normal medium by using I/F controller 201 as an input unit.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixation device comprising:

a first roller;

a second roller facing the first roller via a belt member;

the belt member configured to travel to pass between the first roller and the second roller;

a press member configured to press the belt member against the first roller;

a heater member configured to heat the belt member;

a movement mechanism configured to move at least one of the first roller and the second roller in a first direction where the first roller and the second roller come close to each other and a second direction opposed to the first direction; and a controller configured, based on a type of a medium, to move the at least one of the first roller and the second roller by driving the movement mechanism.

2. The fixation device according to claim 1, wherein the first roller is a pressure roller, the second roller is a fixation roller, and the movement mechanism moves the pressure roller in the first and second directions that the pressure roller comes close to and is spaced away from the fixation roller.

3. The fixation device according to claim 1, wherein
the first roller is a fixation roller,
the second roller is a pressure roller, and
the movement mechanism moves the pressure roller in the first and second directions that the pressure roller comes close to and is spaced away from the fixation roller.

4. The fixation device according to claim 1, wherein
when the type of the medium is a specific type, the controller drives the movement mechanism to move at least one of the first roller and the second roller in such a direction that the first roller and the second roller are spaced away from each other.

5. The fixation device according to claim 1, wherein
when the type of the medium is a specific type, the controller drives the movement mechanism to move at least one of the first roller and the second roller in such a direction that the first roller and the second roller are spaced away from each other, and
in the state where the first roller and the second roller are spaced away from each other, the first roller and the press member are in contact with each other via the belt member.

6. The fixation device according to claim 1, wherein
when the type of the medium is a medium that is capable of wrinkling, the controller drives the movement mechanism to move at least one of the first roller and the second roller in such a direction that the first roller and the second roller are spaced away from each other.

7. The fixation device according to claim 1 further comprising:
a medium introducer provided upstream of a contact between the first roller and the belt member in a conveyance direction of the medium and configured to guide the medium to the contact between the first roller and the belt member; and
a guide unit disposed upstream of the second roller and the press member in a travelling direction of the belt member and configured to guide the belt member, wherein
when the movement mechanism moves the first roller in such a direction that the first roller is spaced away from the second roller, a part of the belt member intersects an extended line of the medium introducer at a position downstream of the medium introducer and upstream of the nip in the conveyance direction of the medium.

8. The fixation device according to claim 7, wherein
the part of the belt member is inclined with respect to the extended line of the medium introducer.

9. The fixation device according to claim 8, wherein
the medium introducer is defined by a pair of opposed medium conveyance surfaces thereof.

10. The fixation device according to claim 1 comprising:
a first bias member configured to bias the press member against the first roller; and
a second bias member configured to bias the first roller against the second roller, wherein
a biasing force generated by the second bias member is larger than a biasing force generated by the first bias member.

11. The fixation device according to claim 10, wherein
a force applied by the belt member to the second bias member is smaller than the biasing force generated by the second bias member.

12. The fixation device according to claim 1, wherein
when the movement mechanism moves the second roller in such a direction that the second roller is spaced away from the first roller, the press member moves in such a direction that a pressing force against the first roller becomes smaller.

13. The fixation device according to claim 1, wherein
when the type of the medium is not a specific type, the controller drives the movement mechanism to move at least one of the first roller and the second roller in such a direction that the first roller and the second roller come close to each other.

14. The fixation device according to claim 1, wherein
when the type of the medium is not a medium that is capable of wrinkling, the controller drives the movement mechanism to move at least one of the first roller and the second roller in such a direction that the first roller and the second roller come close to each other.

15. The fixation device according to claim 1, comprising a first drive transmitter provided substantially coaxially with the second roller, wherein
the movement mechanism comprises:
a supporter configured to hold the first roller rotatably about its own rotation axis, and to rotate about a rotation fulcrum shifted from the rotation axis of the first roller; and
a second drive transmitter disposed substantially coaxially with the rotation fulcrum, and coupled to the first drive transmitter.

16. The fixation device according to claim 15, wherein
the first drive transmitter and the second drive transmitter are both gears.

17. The fixation device according to claim 1, wherein
a first nip portion is formed between the first roller and the second roller, and a second nip portion is formed between the first roller and the press member, and
when the movement mechanism makes the first roller and the second roller spaced away from each other, the first nip portion disappears and the second nip portion remains.

18. The fixation device according to claim 1, wherein
the belt member travels by rotation of the second roller, and
in a state where the movement mechanism causes the first roller and the second roller to be spaced away from each other, rotation torque of the second roller is transmitted to the belt member.

19. The fixation device according to claim 1, wherein
the belt member is an endless belt, and
the press member is arranged at an inner side of the endless belt, and configured to press the endless belt against the first roller from the inner side.

20. An image formation apparatus comprising:
an image formation unit configured to form an image on a medium; and
a fixation device according to claim 1, the fixation device being configured to fix the image to the medium.

* * * * *